US009151565B2

(12) United States Patent
Peterson

(10) Patent No.: US 9,151,565 B2
(45) Date of Patent: Oct. 6, 2015

(54) COMPACT CYCLE AND RECOIL SYSTEM FOR SEMI-AUTOMATIC PISTOLS

(75) Inventor: Brandon Peterson, West Jordan, UT (US)

(73) Assignee: Cold Fire, LLC., Taylorsville, UT (US)

( * ) Notice: Subject to any disclaimer, the term of this patent is extended or adjusted under 35 U.S.C. 154(b) by 190 days.

(21) Appl. No.: 13/161,271

(22) Filed: Jun. 15, 2011

(65) Prior Publication Data

US 2011/0306020 A1 Dec. 15, 2011

Related U.S. Application Data

(60) Provisional application No. 61/355,062, filed on Jun. 15, 2010.

(51) Int. Cl.
*F41A 33/00* (2006.01)
*F41A 33/06* (2006.01)

(52) U.S. Cl.
CPC ..... *F41A 33/06* (2013.01)

(58) Field of Classification Search
CPC ..... F41A 33/02; F41A 33/04; F41A 33/06
USPC ..... 434/11–27
See application file for complete search history.

(56) References Cited

U.S. PATENT DOCUMENTS

| | | | | |
|---|---|---|---|---|
| 3,527,194 | A | 9/1970 | Vadas et al. | |
| 3,938,262 | A | 2/1976 | Dye et al. | |
| 4,302,190 | A | 11/1981 | Shaw et al. | |
| 4,380,437 | A | 4/1983 | Yarborough, Jr. | |
| 4,480,999 | A | 11/1984 | Witherell et al. | |
| 4,678,437 | A | 7/1987 | Scott et al. | |
| 4,830,617 | A | 5/1989 | Hancox et al. | |
| 5,119,576 | A | 6/1992 | Erning | |
| 5,509,399 | A | 4/1996 | Poor | |
| 5,664,552 | A | 9/1997 | Kunimoto | |
| 5,842,300 | A | 12/1998 | Cheshelski et al. | |
| 5,857,854 | A | 1/1999 | Kwalwasser | |
| 5,937,563 | A | 8/1999 | Schuetz et al. | |
| 5,947,738 | A | 9/1999 | Muehle et al. | |
| 5,980,254 | A | 11/1999 | Muehle et al. | |
| 6,146,141 | A | 11/2000 | Schumann | |
| 6,682,350 | B2 | 1/2004 | Kehl et al. | |
| 6,694,658 | B1 | 2/2004 | Marsac | |
| 6,869,285 | B1 | 3/2005 | Jones, II | |
| 6,938,534 | B2 | 9/2005 | Fleming et al. | |
| 7,025,052 | B2 | 4/2006 | Schavone | |
| 7,306,462 | B2 | 12/2007 | Metcalfe et al. | |
| 7,415,977 | B2 | 8/2008 | Chen | |
| 7,581,954 | B2 | 9/2009 | Schavone | |
| 2005/0074726 | A1 * | 4/2005 | Metcalfe et al. | 434/18 |
| 2005/0191601 | A1 | 9/2005 | Dvorak | |
| 2011/0275036 | A1 * | 11/2011 | Rauser | 434/18 |
| 2012/0129136 | A1 * | 5/2012 | Dvorak | 434/18 |

* cited by examiner

*Primary Examiner* — Timothy A Musselman
(74) *Attorney, Agent, or Firm* — Morriss O'Bryant Compagni

(57) ABSTRACT

A firearm training device is structured for use with the user's firearm to provide realistic simulation of the firing, recoiling and re-cocking of the weapon, while enabling the use of the training device without modification to the firearm in order to accommodate the training device, the training device being receivable in the magazine compartment of the firearm and being easily removed therefrom.

17 Claims, 3 Drawing Sheets

COMPACT CYCLE AND RECOIL SYSTEM FOR SEMI-AUTOMATIC PISTOLS

CROSS REFERENCE TO RELATED APPLICATIONS

This is a non-provisional application which claims priority to U.S. provisional Ser. No. 61/355,062, filed Jun. 15, 2010, the contents of which are incorporated herein, in their entirety, by reference.

FIELD OF THE INVENTION

The present invention relates to firearms accessories, training devices, and firing simulators for firearms, and specifically relates to a training aid for semi-automatic pistols.

DESCRIPTION OF THE PRIOR ART

It is common for users of firearms, such as police, military and civilian firearms enthusiasts, to train in the use of the firearm to improve firing and defensive skills. Thus, it has been desirable to employ training means for improving those skills. Police and military agencies have long used training ranges to practice with live ammunition using service firearms. Such agencies also use simulator devices that enable agency personnel to practice their firing skills using non-live ammunition or simulated weaponry.

To provide users with means for improving or enhancing their skills with firearms, many devices have been developed to provide the user with as accurate a simulation of firing a firearm as possible. These systems or devices have been developed for various types of firearms, but most usually for semi-automatic styles of firearms.

Currently there are generally two methods for providing semi-automatic pistol training without using live ammunition, or dry firing. The first method is to supply the trainee with a simulated firearm. The simulated firearm may be an actual firearm that has been permanently modified for training purposes or a replica firearm that is designed to look and feel like a real firearm. The second method is to allow the trainee to use his or her own firearm with a temporary conversion kit.

The problems associated with the first method are that use of a simulated weapon introduces an increase in cost in that the user must have both a simulated weapon and the actual weapon, and the differences between the trainee's actual weapon and the simulated weapon requires the trainee to translate the training experience between the simulated firearm and the actual firearm.

The main problem with the second method is that the current conversion kits require the user to replace the existing slide and/or barrel of the firearm with one that contains the system components of the conversion kit, or the conversion kit requires the slide, frame and/or the barrel of the firearm to be modified considerably to accommodate the conversion kit. Other devices are structured such that a replacement barrel is required, and the replacement barrel is designed not to interlock with the slide of the firearm. As a result, mechanisms of the training device do not operate in a manner that can simulate the actual firing of the weapon.

Examples of training devices are disclosed in U.S. Pat. No. 5,842,300, which describes a retrofitted laser system for a firearm comprising a replaceable barrel assembly. The '300 patent requires that the barrel be replaced with a different barrel structure during use of the disclosed system. The '300 patent is limited in the type of firearms to which the disclosed system can be adapted. Reference is made in the disclosure to the DAO (Double Action Only) style or firearm or to modified Clocks. In any other firearm, the user must manually re-cock the firearm for each trigger pull. US Patent Application No. 2005/0191601 discloses a similar firearm training device that employs a pneumatic recoil mechanism positioned in the barrel of the firearm.

The objective of prior known firearm training devices is to replicate as closely as possible the feel of firing live rounds. While some designs allow for more or less of the components in the system to be included in the replacement barrel instead of the replacement magazine, the general concept remains the same. This methodology results in an increase in cost and complexity that makes the technology unfeasible for consumers with limited time and/or money.

Therefore, it would be beneficial in the art to provide a firearm training mechanism for a semi-automatic pistol that replicates in the user's firearm the feel and action of the actual firing of live ammunition, and that replicates the actual operation of the firearm without, for example, having to manually operate the slide. It would also be beneficial to provide a training device that simply replaces the magazine of the firearm, without requiring any modification to any other elements of the firearm, and which enables the training device to simply be removed and replaced by the magazine to return the firearm to full operation. Accordingly, firearm users are spared the cost of separate simulation firearms since their own firearm may be used for training, and the user retains the memory gained from training with his or her own weapon without having to transfer and adapt learned techniques from a simulated weapon to the user's own weapon.

BRIEF SUMMARY OF THE INVENTION

In accordance with the present disclosure, a firearm training device is structured for use with the user's firearm to provide realistic simulation of the firing, recoiling and recocking of the weapon, while enabling the use of the training device without modification to the firearm to accommodate the training device. Therefore, the training device of the present invention is simple to use and economically available to all firearms user and enthusiasts.

In one aspect of the invention, the device is structured as a replacement magazine for the ammunition magazine of the firearm, and is structured to be accommodated in the firearm without modification of the weapon. The mechanism is adaptable to the firing structures of the firearm to facilitate the insertion and removal of the training device from the weapon.

In another aspect of the invention, compressed gas is used as a means for cycling the simulated firing operation and to automatically cycle the gun when the trigger is pulled. This allows the user to fire repeatedly without using live ammunition and without needing to manually re-cock the gun. The device does not fire a projectile device and, therefore, provides a safe method for improving the techniques of good marksmanship. Green gas, Propane, pressurized $CO_2$ and compressed air are among the many types of gases that may be used in the invention.

In another aspect of the present invention, the firearm training device comprises a mechanism that is configured to be placed within the magazine well of the firearm, and to operate with the existing elements of the firearm, to provide realistic recoil and operation of the firearm. The present invention thereby overcomes the problems inherent in other firearm training devices by providing a mechanism that is wholly contained within the existing firearm and which enables training with an actual firearm.

In another aspect of the invention, a safe method is provided for performing training exercises with an actual semi-automatic pistol without the use of live ammunition, or dry firing, which can be harmful to the working elements of a firearm. The training device of the present invention provides a safe method of pneumatically cycling, or re-cocking, a fully functional semi-automatic pistol.

In a particularly unique aspect of the present invention, a mechanism is provided for conducting firearm training exercises without requiring any modification to the firearm. However, the training device of the present invention can nonetheless be adapted to certain types of firearms that otherwise, by their construction, would limit the ability to receive the training device of the present invention. Accordingly, if the design of the firearm does not contain enough room for operation of the firing mechanism of the training device, a low cost alternative barrel may be temporarily used with the present invention. Swapping out the existing barrel with an alternative barrel is a minor modification and readily adapts to the style of firearm without requiring permanent modification to the firearm. Notably, the purpose of the alternative barrel is only to allow additional space to accommodate the firing mechanism of the training device of the present invention, unlike prior known training devices which require replacement or modification of the existing barrel of the firearm so that the replacement of modified barrel can provide a functional component of the training device. A possible exception is the configuration of the present invention to accommodate pistol designs other than the M1911 pistol.

In another aspect of the invention, the training mechanism is particularly limited in size, with the exception of the catch assembly, to the same size as the actual magazine designed for the firearm. Thus, the mechanism is slidably received in the magazine well of the pistol and the need for modifying or machining to pistol to accommodate the training device or mechanism is obviated.

BRIEF DESCRIPTION OF THE DRAWINGS

In the drawings, which illustrate what is currently considered the best mode for carrying out the invention.

DETAILED DESCRIPTION OF THE ILLUSTRATED EMBODIMENTS

Figure 1:
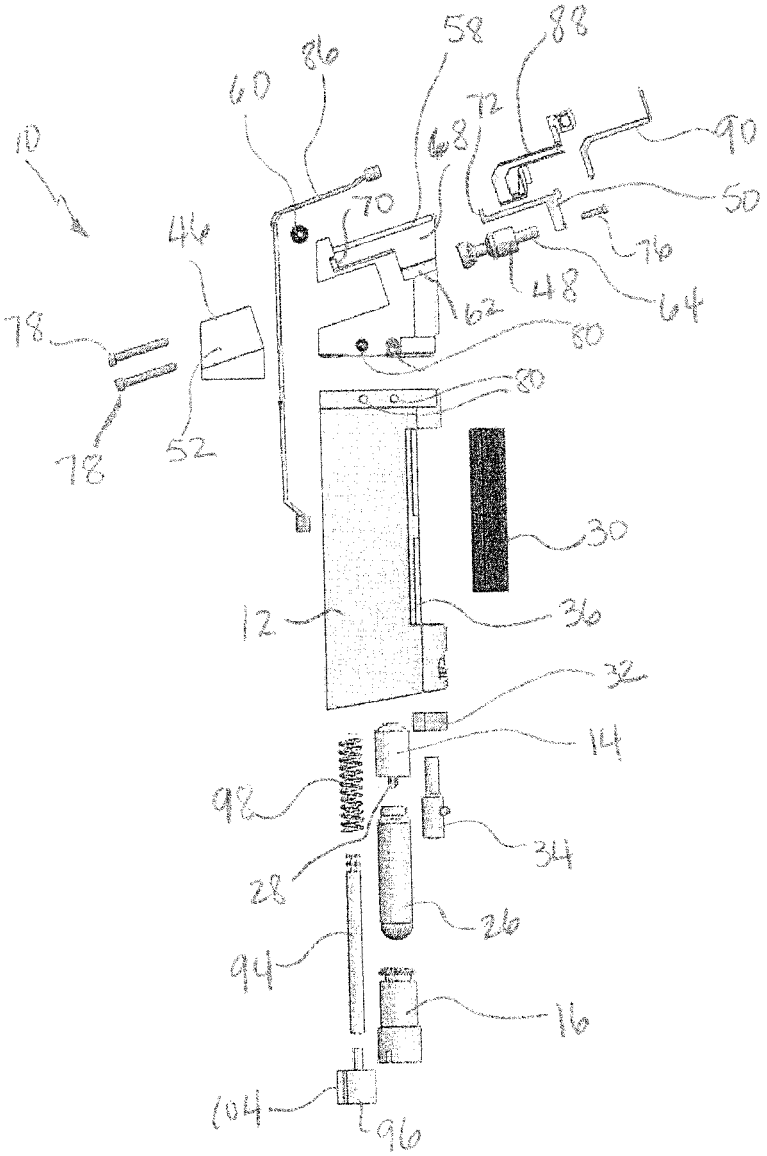
FIG. 1 illustrates an exploded view of one possible embodiment of the training device.

The structural means for providing a mechanism for carrying out the general principals and objectives of the present invention may vary. One exemplar aspect or embodiment of the invention is illustrated in FIG. 1, which shows the basic elements of the invention in an exploded view. In general, the training device comprises a body assembly, a grip assembly, a valve assembly, a drive assembly, a rail assembly and a catch assembly, all of which are conjoined to provide a realistic simulation of the firing of the weapon.

Figure 2:
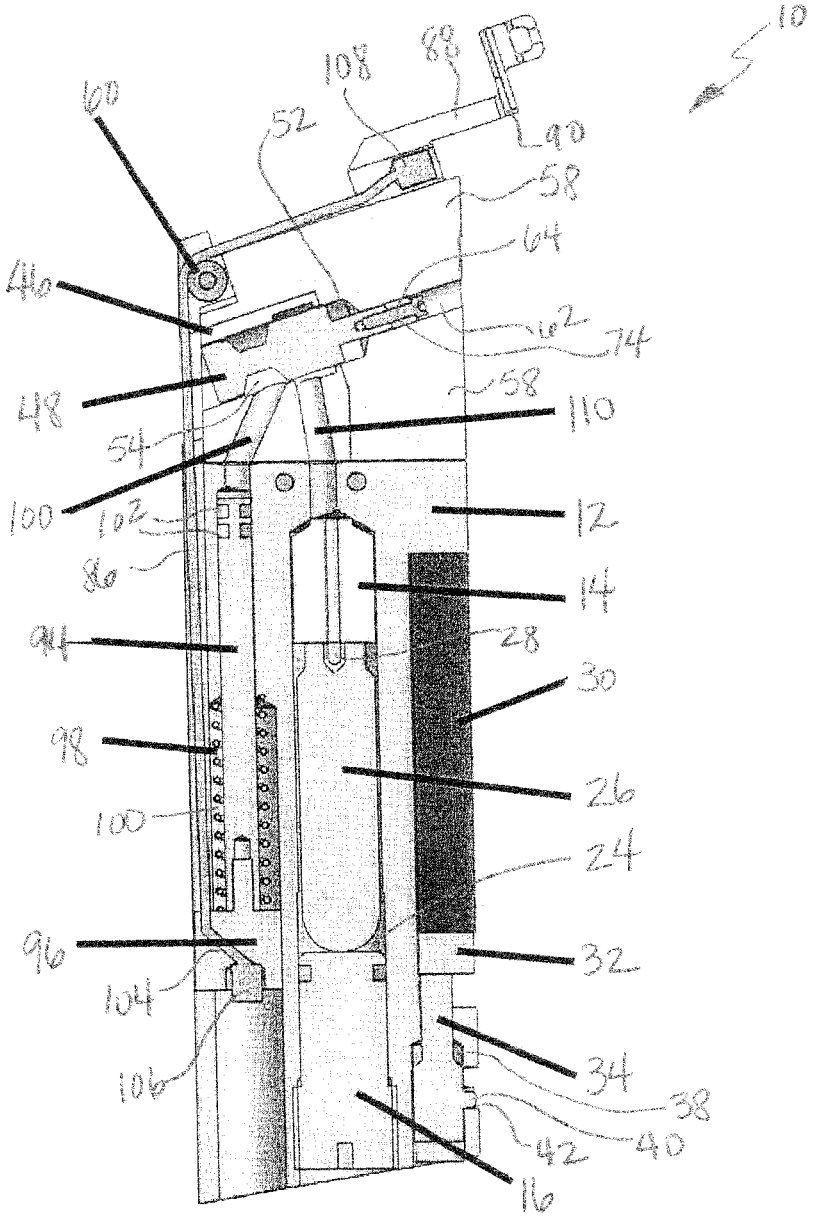
FIG. 2 is a view in cross section of the assemblage of the embodiment shown in FIG. 1.

The training device 10, as shown in FIGS. 1 and 2, includes a body assembly that is composed of three main parts: a body housing 12, a punch 14 and a plug 16. The body housing 12 is generally structured in the manner of a magazine-like member that is sized to fit within and interact with the magazine compartment of well 20 (FIG. 3) of the firearm 22. The body housing 12 is structured to allow the assemblage of the present invention to be easily inserted into and extracted from the firearm without modifying or replacing parts on the firearm.

The body housing 12 is structured with an inner chamber 24 that is configured to receive and retain a force mechanism, the operation of which, in conjunction with other elements, provides the realistic simulation of the firing of the weapon. In this instance, the force mechanism may further be characterized as comprising a $CO_2$ cartridge 26 containing pressurized $CO_2$. In assembly of the training device, the punch 14 is inserted into the chamber 24 first, followed by the $CO_2$ cartridge 26, and then followed by the plug. The punch 14, which is structured with a piercing end 28, operates to puncture the $CO_2$ cartridge 26 to cause a release of $CO_2$ gas, and the plug 16 operates to seal the chamber 24 from the outside and to applying the necessary initial pressure to rupture the $CO_2$ cartridge 26.

The grip assembly of the training device 10 is responsible for securing the device within the magazine well of the firearm during use. The grip assembly is generally composed of a grip 30, a grip press 32 and a grip key 34. The grip key 34 is designed to lock in two positions within the housing body 12 of the device, the first position being an unlocked position and the second being a locked position. In the locked position, the grip key 34 pushes on the grip press 32, which slides on a rail 36 formed into the body of the device. The grip press 32 transfers this pressure into the rubber grip 30, which then expands laterally to create pressure and friction between the rubber grip 30 and the magazine well 20 of the firearm.

In one aspect of the grip assembly as shown in FIGS. 1 and 2, the grip key 34 may be structured to be slidably received in a channel 38 formed in the housing body 12, and to be rotatable within the channel. The grip key 34 may also be structured with a radially-extending pin 40 that is supported on a shoulder 42 that is formed with the channel 38. Thus, the grip key 34 is locked into position when the pin 40 is resting on the shoulder 42, and release of the pin 40 from the shoulder 42 allows the grip key 34 to move slidably through the channel 38 to release pressure on the grip press 32 and grip 30, thereby allowing the training device 10 to be removed from the magazine well 20. The pin 40 may, in one aspect of the invention, be a detent.

The valve assembly of the device is responsible for controlling the flow of gas within the device to operate the simulated firing mechanisms of the training device 10. More specifically, the valve assembly is comprised generally of a valve body 46, a valve rod 48 and a valve end 50. The valve assembly of the illustrated embodiment is designed to act as a 3-way valve having two positions—a primary, or off, position and a second, or on position, as described more fully below. The valve body 46 is the main part of the valve assembly and forms, in combination with the rail assembly, a valve chamber 52 and air ports 54, as shown more clearly in FIG. 2. The valve rod 48 is slidably positioned within the valve chamber 52 in a manner described further below, and is responsible for creating seals within the valve assembly as described further below. The valve rod 48 is moved within the valve chamber 52 by the valve end 50. The rail assembly of the training device 10 is generally comprised of a rail member 58 and a cable bearing 60. The valve body 46 is structured to interfit with the rail member 58 to form the valve chamber 52 in which the valve rod 48 is slidably disposed. The rail member 58 is also configured with an aperture 62 through which a cylindrical end 64 of the valve rod 48 is slidably positioned.

The rail member 58 is further configured with a groove 68 in which the valve end 50 slidably travels. The track 68 is formed with a stop 70 which contacts the inner terminus 72 of the valve end 50 to define an end point of travel of the valve end 50 within the track 68. The cylindrical end 64 of the valve rod 50 fits through an opening 74 in the valve end 50 and is secured in place with a screw 76 or equivalent securement device. The rail member 58 and valve body 46 are joined to the housing body 12 by screws 78 positioned through holes 80 in the housing body 12.

The cable bearing 60 is attached to the rail member 58 with a set screw 84 and is positioned to engage a cable 86, as described more fully below.

The catch assembly is the only part of the training device 10 that is designed to extend beyond the magazine compartment of the firearm. The location of the firing chamber relative to the magazine compartment of the firearm and the clearances between the slide, frame, and barrel, create model-specific design requirements for the catch assembly. The catch assembly is generally comprised of a slide catch 88 and pin catch 90. The slide catch 88 travels in the track 68 formed in the rail member 58 and is responsible for transferring the force from the cable 86 to the slide of the firearm. At the end of its travel the slide catch 88 will close the valve assembly by acting upon the valve end 50, as described further below.

The pin catch 90 attaches to and travels with the slide catch 88, but is slidable independently of the slide catch. The pin catch 90 is responsible for transferring the energy from the firing pin of the firearm to open the valve assembly, as described more fully below.

The drive assembly of the training device 10 is responsible for implementing the force required to cycle the firearm with the gas pressure supplied by the valve assembly. The drive assembly is generally comprised of a drive rod 94, a drive rod end 96, a spring 98 and cable 86. The drive rod 94 is sealed within a drive port 100 formed in the housing body 12 using o-rings 102 to provide a fluid seal. The drive end 96 is threaded into the end of the drive rod 94 and provides a retaining element 104, such as a slot, through which the cable 86 is secured. A boss 106 formed on an end of the cable 86 may be supported and secured to the drive end 96. The opposing end of the cable 86 may also be formed with a boss 108 that is secured in the slide catch 88. The drive end 96 is responsible for holding the cable 86 securely with respect to the drive rod 94 and transferring the force from the spring 98 and drive rod 94 into the cable 86. The spring 98 surrounds the drive rod 94 and is biased between the housing body 12 and the drive end 96. The spring 98 operates to offset the pressure in the firearm.

As shown further in FIG. 2, the valve body 46 and rail are configured to provide a pressure port 110 and a portion of the drive port 100 that are in fluid communication with each other via the valve chamber 52. When the valve rod 48 is in the primary or off position, the valve rod 48 is positioned to connect the drive port to the atmosphere and the valve rod 48 seals off the pressure port 110, as shown in FIGS. 1 and 2. When in the secondary, or on, position the valve rod 48 slides within the valve chamber 52 to provide fluid communication between the pressure port 110 and the drive port 100, as described further below.

Figure 3:
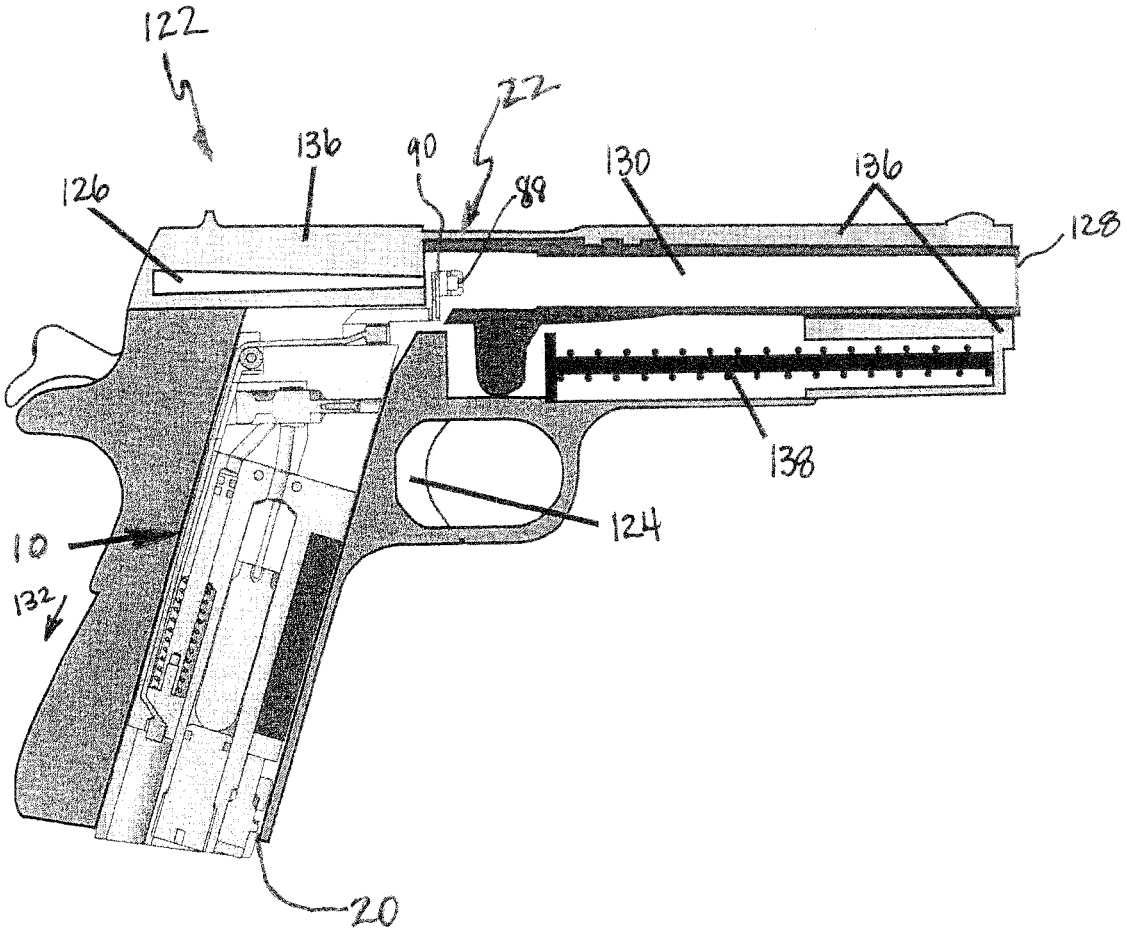
FIG. 3 is a view in cross section of the embodiment of the invention shown in FIG. 2, installed in an M1911 type semi-automatic firearm.

The following provides a description of the operation of the training device of the present invention, with particular reference to FIG. 3 which illustrates the training device 10 positioned in the magazine compartment 20 of the firearm 122. Upon depression of the trigger 124 of the firearm 122, the firing pin 126 of the firearm is caused by the trigger 124 to move forward. As used herein, "forward" denotes a direction oriented toward the exit end 128 of the barrel 130 and "rearward," or "rear" denotes a direction oriented away from the exit end of the barrel 130. In its forward travel, the firing pin 126 contacts the pin catch 90, which slides longitudinally relative to, but while still connected to, the slide catch 88, which remains momentarily stationary. As the pin catch 90 is urged forward by the firing pin 126, the pin catch 90 effects movement of the valve assembly.

That is, the pin catch 90, which is structured to engage the valve end 50 and, thus, the valve rod 48, causes the valve rod 48 to move to an open position whereby a fluid pathway is provided between the pressure port 110 and the drive port 100 via the valve chamber 52. Compressed $CO_2$ from the $CO_2$ cartridge 26 moves from the pressure port 110 into the drive port 100 via the pathway through the valve chamber 52.

The increased pressure in the drive port 100 forces the drive rod 94 in a downward direction, as indicated by the arrow 132. As a result, the drive rod 94 pulls on the cable 86, which is attached at the other end to the slide catch 88, and moves the slide catch 88 rearward. The slide catch 88 moves the slide 136 of the firearm 122 towards the rear a small distance (e.g., approximately 0.8 inches). Upon reaching the end of its travel, the slide catch 88, which is connected to the pin catch 90, which is in turn connected to the valve rod 48, forces the valve rod 48 rearward thereby causing the valve assembly to close, terminating the fluid communication between the pressure port 110 and the drive port 100.

The slide 136 continues towards the rear of the firearm 122, re-cocking it in the process. Upon completion of its travel the momentum of the slide 136 causes a simulated kick. The spring 138 of the firearm that engages the slide 136 moves the slide 136 forward. As the slide 136 then impacts the slide catch 88 of the training device 10, the slide catch 88 is driven forward pulling the cable 86 with it. The movement of the cable 86 causes the drive rod 94 to reset. When the slide 136 reaches the end of its travel forward, the firearm is ready to fire again. The foregoing description is illustrative of just one embodiment for configuring the present invention. The specific elements of the invention may be modified within the scope of the invention to adapt it to various firearms.

What is claimed is:

1. A firearm training device, comprising:

A housing body sized and configured for receipt in the magazine compartment of a firearm;

a catch assembly positioned to engage with the slide of a firearm to effect movement of the slide and to be moved by the slide, the catch assembly being connected to and slidably engaged with the housing body;

a pin catch connected to the catch assembly and being operatively positioned to activate a force mechanism that is positioned adjacent to the housing body, the pin catch being positioned to contact the firing pin of a firearm and to be slidable with the movement of the slide of a firearm; and a drive assembly operatively driven by said force mechanism and being operatively attached to said catch assembly to effect movement of said catch assembly.

2. The firearm training device according to claim 1, wherein said force mechanism is compressed gas.

3. The firearm training device according to claim 2, further comprising a valve assembly engaged by the housing body and having a slidable valve rod that is movable from an open position to a closed position such that, when in the open position, the valve rod provides a fluid pathway between the valve assembly and the drive assembly.

4. The firearm training device according to claim 2, wherein said compressed gas is provided from a $CO_2$ cylinder positioned within said housing body.

5. The firearm training device according to claim 4 wherein said drive mechanism further includes a plug positioned adjacent said $CO_2$ cylinder to provide an urging force against said $CO_2$ cylinder.

6. The firearm training device according to claim 4 wherein said drive assembly further comprises a spring positioned with said drive rod within said housing body to offset the force of the spring of a firearm.

7. The firearm training device according to claim 1 wherein said drive assembly further comprises a drive rod connected to said catch assembly by a cable.

8. The firearm training device according to claim 1, further comprising a grip assembly attached to the housing body for removably securing the housing body in the magazine compartment of a firearm.

9. A firearm training device for a pistol, comprising:

a housing body sized to be received in the magazine compartment of a pistol;

a source of compressed gas positioned within said housing body;

a valve assembly positioned adjacent said housing body and operatively connected through a pressure port to said source of compressed gas;

a drive assembly operatively connected to said valve assembly by a drive port in fluid communication with said pressure port; and a catch assembly operatively connected to said drive mechanism and positioned relative to the housing body to be slidably movable along a portion of the housing body, said catch assembly being positioned to contact the slide of a pistol for movement of the slide.

10. The firearm training device according to claim 9 wherein said source of compressed gas is a $CO_2$ cylinder.

11. The firearm training device according to claim 9, wherein said valve assembly is operatively connected to said catch assembly to be movable between an open valve and closed valve position by operation of said catch assembly.

12. The firearm training device according to claim 9, wherein said drive assembly further comprises a drive rod operatively connected to said catch assembly by a cable.

13. The firearm training device according to claim 9, further comprising a grip assembly positioned to removably secure said housing body to the magazine of a pistol, wherein said grip assembly further comprises an elastomeric grip and a grip press positioned to apply pressure to said elastomeric grip to laterally expand said grip to secure said grip assembly to the magazine compartment of a pistol.

14. The firearm training device according to claim 9, wherein said catch assembly further comprises a pin catch operatively connected to said valve assembly to effect movement of said valve assembly from a closed to an open position.

15. The firearm training device according to claim 14, wherein said catch assembly further comprises a slide catch which is slidably connected to said pin catch and which is positioned to contact the slide of a firearm to effect movement of a slide of a firearm to simulate the firing protocol of a pistol.

16. A method of using a firearm training device for training with a firearm, comprising:

providing an operable firearm having a frame, a barrel, a firing pin, a slide, a trigger and a magazine compartment formed in the frame of the firearm;

removing the existing magazine from the magazine compartment of the firearm;

inserting into the empty magazine compartment of the firearm a firearm training device structured with all components necessary to produce a simulated firing and recoiling in the firearm, the training device comprising a housing body, drive assembly and force mechanism sized to fit within the magazine compartment of the firearm without modification of the firearm, and a catch assembly connected to and slidably movably along a portion of the housing body and positioned to contact the slide of the firearm;

pulling the trigger of the firearm to activate the force mechanism of the firearm training device to effect sliding movement of the catch assembly along the housing while in contact with the slide of the firearm;

wherein the drive assembly of the training device acts upon the existing slide of the firearm to cause a simulated firing of the firearm and to produce a re-coiling of the firearm.

17. The method accordingly to claim 16 wherein the operable firearm is selected to have a barrel configured to spatially accommodate the drive assembly of the firearm training device.

* * * * *